United States Patent [19]

Houston

[11] Patent Number: 4,859,144

[45] Date of Patent: Aug. 22, 1989

[54] FAN STAGE CONFIGURATION

[75] Inventor: William S. Houston, Uniontown, Ohio

[73] Assignee: The Hoover Company, North Canton, Ohio

[21] Appl. No.: 164,980

[22] Filed: Mar. 7, 1988

[51] Int. Cl.[4] ..... F04D 29/44

[52] U.S. Cl. ..... 415/210; 415/199.3

[58] Field of Search ..... 415/210, 199.2, 199.3, 415/199.1, 209, 216

[56] References Cited

U.S. PATENT DOCUMENTS

| | | | |
|---|---|---|---|
| 1,408,715 | 3/1922 | Seelig et al. | 415/210 |
| 1,561,847 | 11/1925 | Green | 415/199.2 |
| 1,857,486 | 5/1932 | Trumpler | 415/199.3 X |
| 2,262,854 | 11/1941 | Morris | 415/210 X |
| 2,954,739 | 10/1960 | Lung | 415/199.3 X |
| 3,116,696 | 1/1964 | Deters | 415/199.3 X |
| 3,612,716 | 10/1971 | Deters | 415/199.3 X |
| 4,135,852 | 1/1979 | Archibald | 415/199.3 |
| 4,564,334 | 1/1986 | Hergt et al. | 415/199.3 |

*Primary Examiner*—Everette A. Powell, Jr.

[57] ABSTRACT

The invention comprehends an inter or after stage of a fan system in which the stage has curvilinear spiralling guidance blades and integral blade tips angled in an axial direction to provide guidance for air flow to the spiralling guidance blades.

3 Claims, 4 Drawing Sheets

FAN STAGE CONFIGURATION

BACKGROUND OF THE INVENTION

1. Field of the Invention

This invention relates to fans and, more specifically, relates to a centrifugal fan having an inter stage and/or an after or discharge stage.

2. Summary of the Prior Art

Inter stage and after stage devices for centrifugal fan systems are known and have been utilized with fans and fan systems for many years. It is also known to provide blading or shrouds for these devices which tend to turn the flow of the centrifugal fan stage discharge. An attempt has been made, in many instances, in the design of the blading or shrouding, to obtain a smooth transition at the discharge from the centrifugal fan. This has taken, generally, the form of a separate structure to define the desired air flow channel, leaving an intermittent or discontinuous guided flow path for the centrifugal fan discharge. This causes losses and inefficiencies of some magnitude for the discharge flow from the fan system.

Accordingly, it is an object of the invention to provide a guidance arrangement for the flow of discharge air from a fan having improved static recovery and efficiency.

It is a further object of the invention to provide guidance blading operative to smoothly guide air axially towards a discharge port or a centrifugal fan eye.

It is an additional object of the invention to provide continuous blading for an inter stage or after stage which turns the fan discharge from an outward tangential direction to an axial, radial direction.

It is a still further object of the invention to incline the outer ends of stage blades in an axial direction to provide guidance for the fan discharge as it moves to a fan eye or central discharge point.

It is an even further object of the invention to angle the blade tip ends of continuous blades axially to accommodate a streamlined flow for a motor-fan system.

It is also an object of the invention to angle the blade tips end, at an angle axially to accommodate the operating point of the motor-fan system.

SUMMARY OF THE INVENTION

The invention contemplates a motor-fan having one or more centrifugal fans and a possible stator inter stage and/or a stator after stage. The centrifugal fan or fans, conventionally, takes the form of a series of curvilinear blades mounted between two end plates and centered with the center of rotation of the fan. These fans are driven to rotate at high speed by being mounted on a shaft rotatably driven by an electric motor or the like. Disposed downstream or behind each fan is a stator stage also including curvilinear blades which tend to lead the peripherally, tangentially discharged fan air radially inwardly for a central, axial discharge to the next stage fan or to discharge from the fan system.

In order to smoothly accomplish this function, the stator stage blades are inwardly, curvilinear, leading to a central discharge point while, at their tips, they are angled curvilinearly in an axial direction to help turn the air, tangentially discharged from the fan tips. These differently angled blade sections also merge smoothly with each other so as to form a continuous generally non turbulent guidance arrangement for the air flow from the fan. The blade tips may be advantageously specifically angled to accommodate the operating point of the motor fan system.

BRIEF DESCRIPTION OF THE DRAWINGS

Reference may now be had to the accompanying Drawings for a better understanding of the invention, both as to its organization and function, with the illustration being of a preferred embodiment, but being only exemplary, and in which.

DETAILED DESCRIPTION OF THE INVENTION

Figure 1:
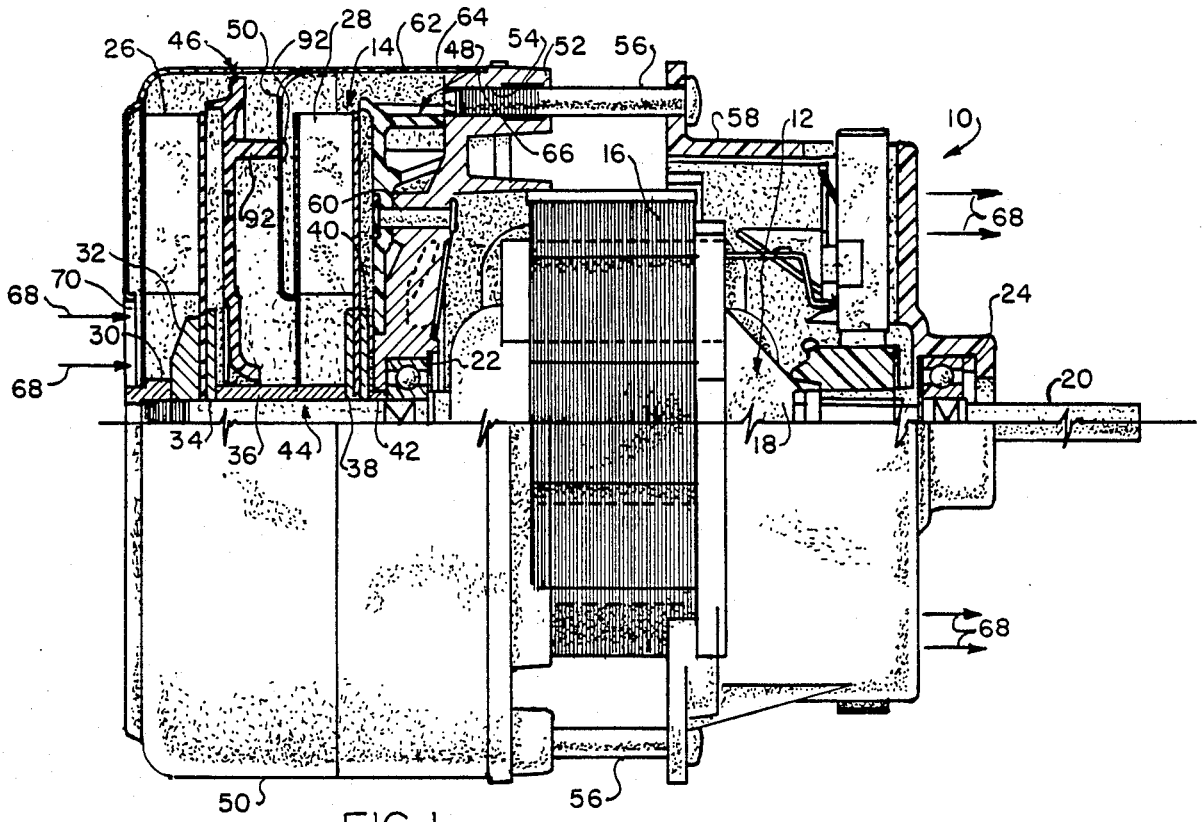
FIG. 1 is a side view, partly in cross section, of a motor fan system encompassing my invention.
Figure 4:
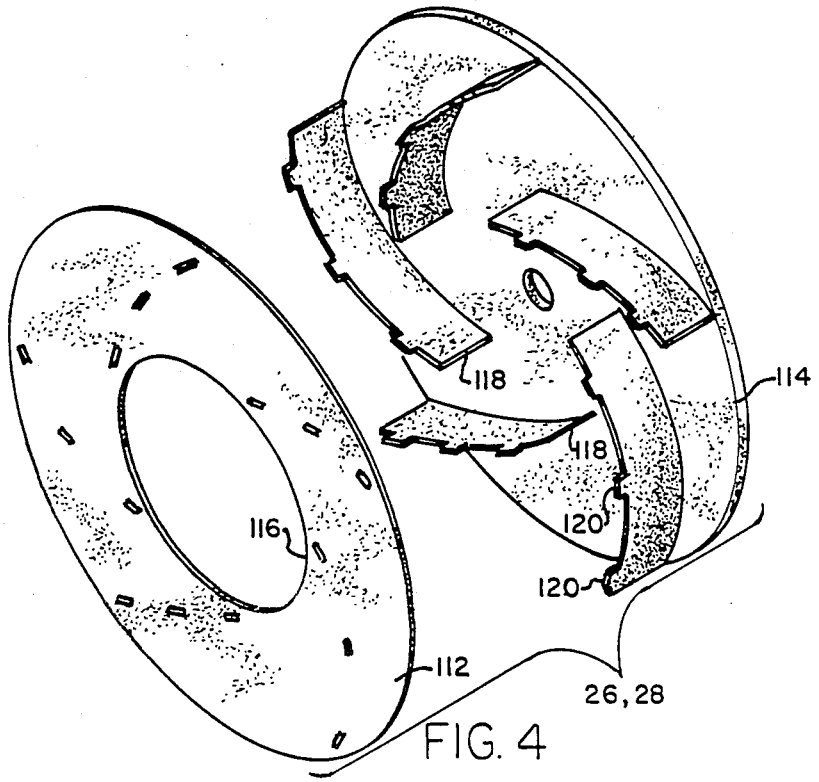
FIG. 4 is an exploded perspective view of a centrifugal fan utilized in the structure of FIGS. 1 and 2.
Figures 2, 5, 11:
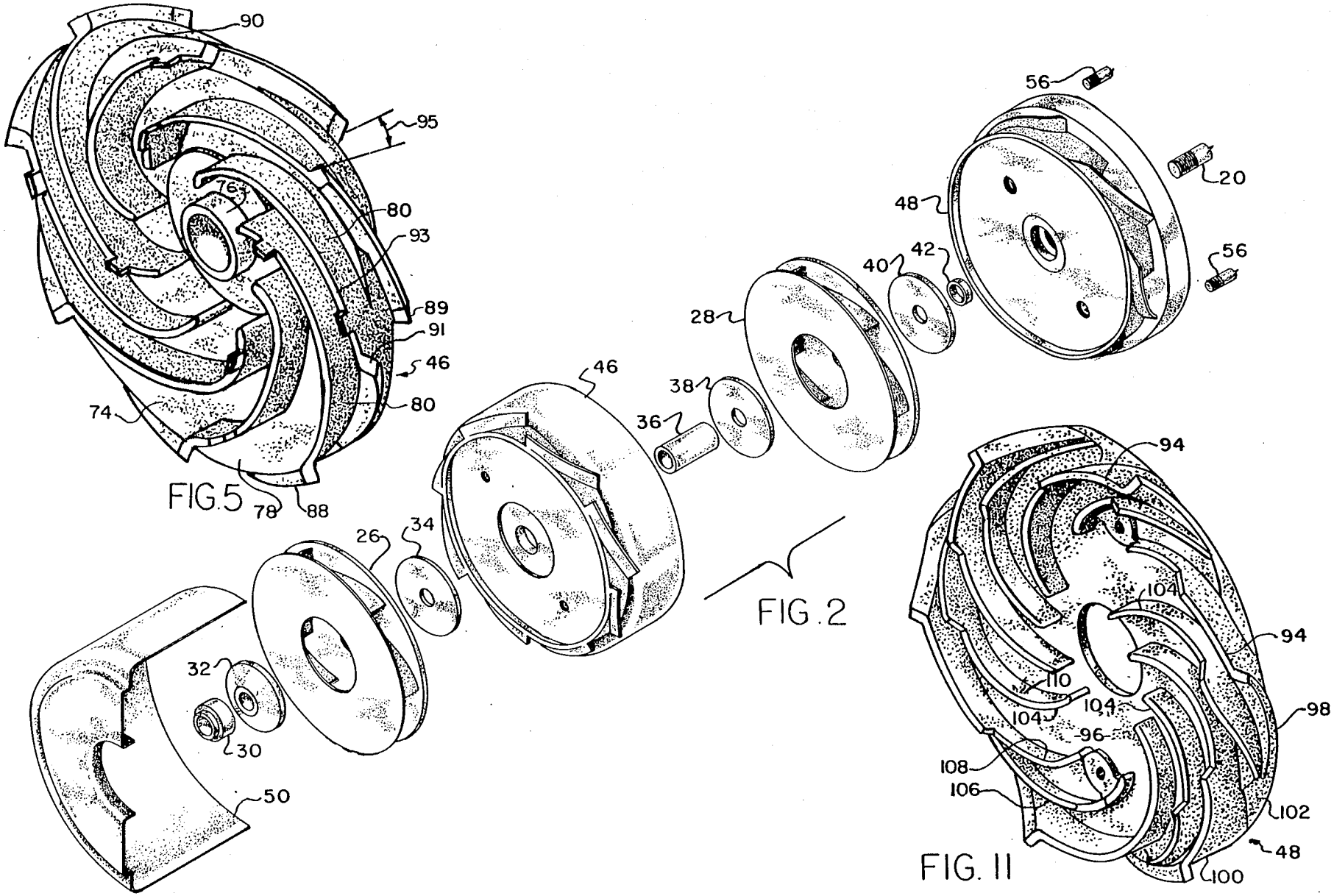
FIG. 2 is an exploded perspective view of the fan system of FIG. 1.
FIG. 5 is a perspective view of the inter stage stator.
FIG. 11 is a perspective view of the after stage of FIG. 10.
Figure 3:
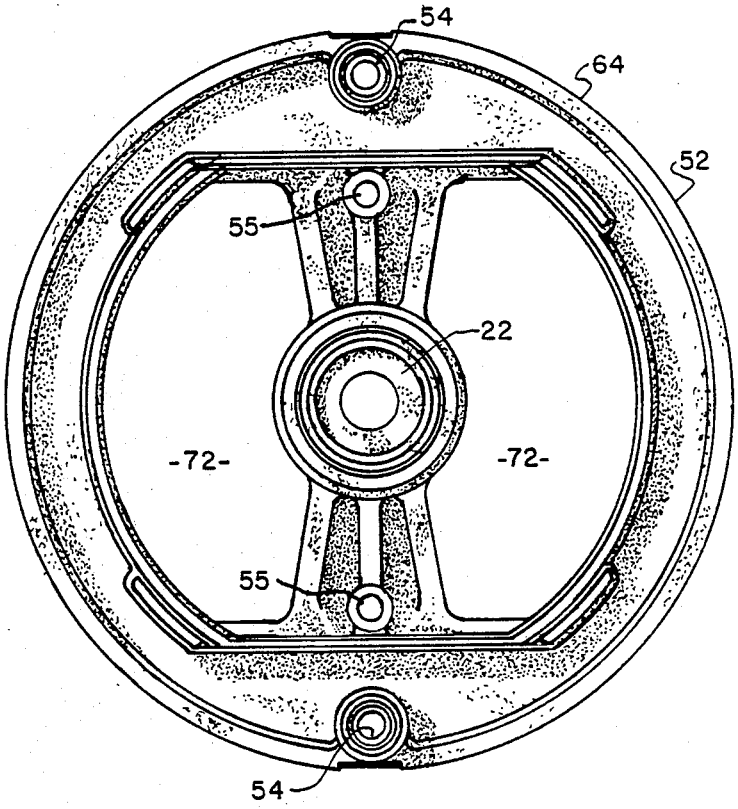
FIG. 3 is an end elevational view of the motor bearing retainer plate.
Figure 10:
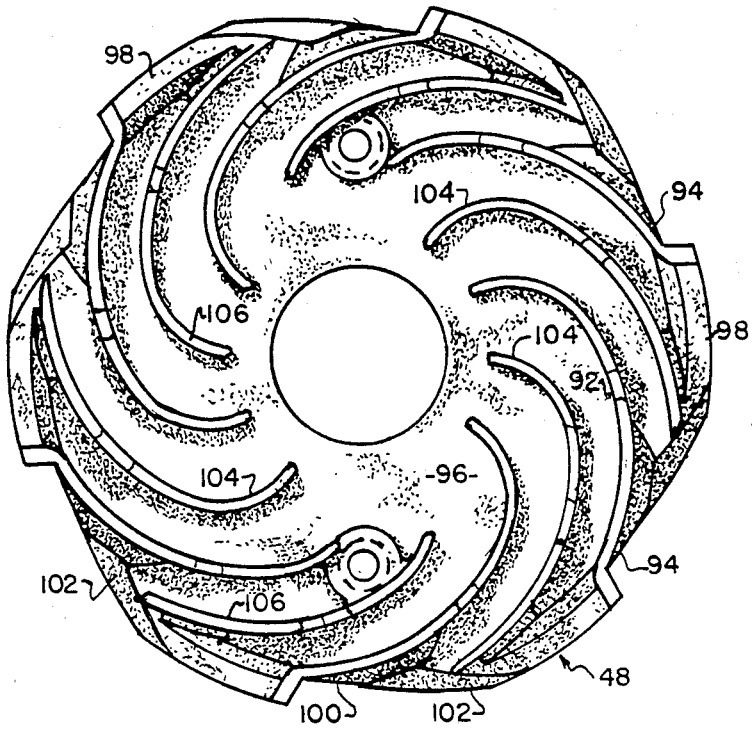
FIG. 10 is an elevational view of the after stage of the fan system.
Figure 7:
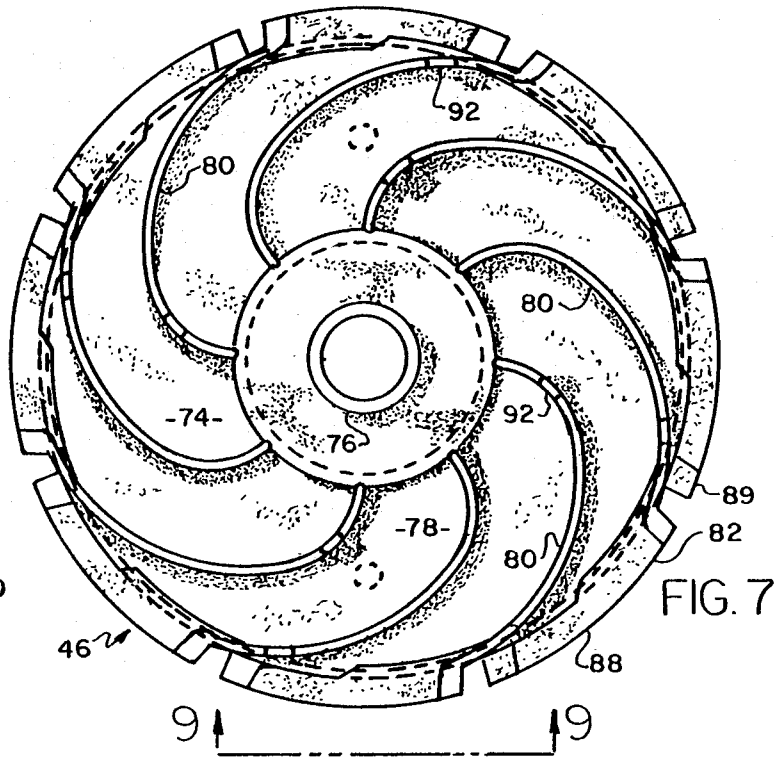
FIG. 7 is a front elevational view of the stator of FIG. 5.
Figure 8:
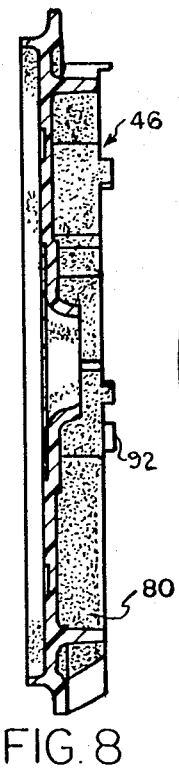
FIG. 8 is a cross sectional view of the inter stage stator taken on line 8—8 of FIG. 6.
Figure 9:
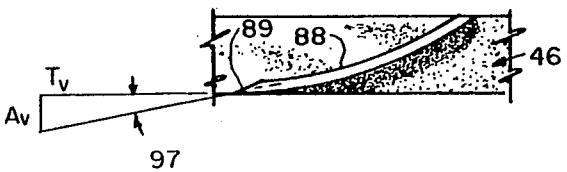
FIG. 9 is a view taken on line 9—9 of FIG. 7 and showing an axially angled tip.
Figure 6:
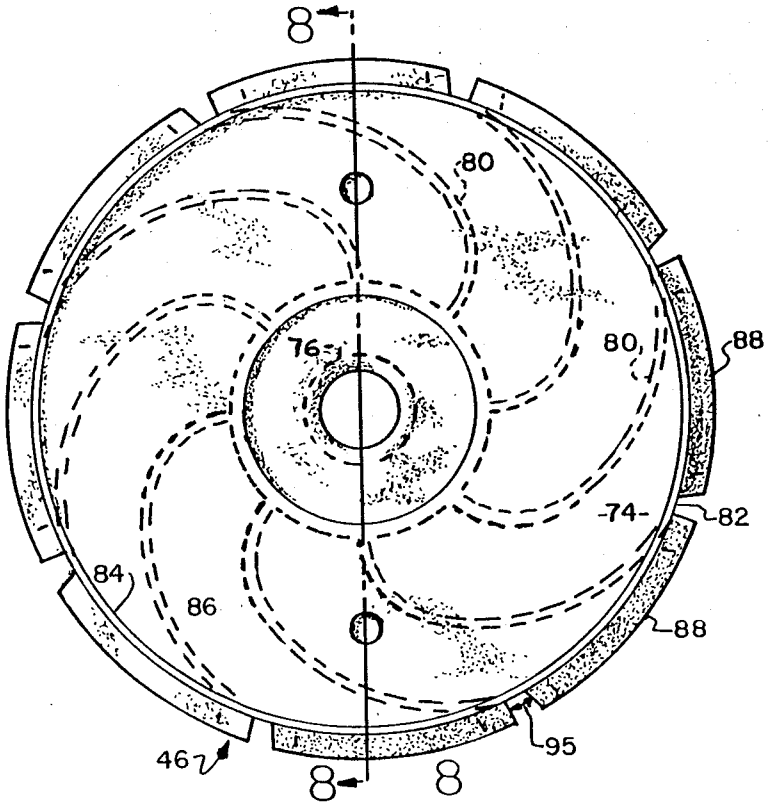
FIG. 6 is a rear elevational view of the stator of FIG. 5.

There is shown in FIG. 1, a motor fan system 10 including an electric motor 12 an a staged fan system 14. The motor 12 includes a stator 16 and an armature 18 attached to a driving shaft 20. Shaft 20 is mounted to rotate in bearings 22 and 24 so as to rotatably drive the staged fan system 14. This fan system includes a pair of fans 26, 28.

The fans 26, 28 are clampingly held on drive shaft 20 in compression between a balancing ring 32 and a washer 34, disposed on opposite sides of the fan 26, an elongated fan space 36 disposed generally between the fans 26 and 28 on shaft 20, a pair of washers 38, 40, disposed on opposite sides of fan 28, and a bearing spacer 42, disposed between the washer 40 and the bearing 22. A fan assemblage 44 is thereby formed fast with the shaft 20 so as to rotate with it as it is driven by the electric motor 12, with this assemblage captivated between compression nut 30 and bearing 22.

Mounted non-rotatably also, as a part of the staged fan system 14 are an inter stage 46 and an after stage or discharge 48. The inter stage 46 is mounted fast to a fan cover 50 while the after stage 48 is mounted to a motor bearing retainer plate 52. This is accomplished in the following manner.

The bearing retainer plate 52 is provided with a pair of threaded bores 54, 54 through which bolts 56, 56 are threaded, with the heads of the bolts 56, 56 engaging with a housing 58 or the electric motor 12.

After or discharge stage 48 is then mounted by rivets 60, 60 (only one shown) to the bearing retainer plate 52, these rivets passing through bores 55, 55 in the bearing retainer plate 52. This connection prevents the after stage 48 from rotating relative to the fans 26 and 28. The inter stage 46 is also prevented from rotating by being mounted with a second fan cover 62 through the aegis of struck over tabs, like the integral tab 64, which mount the inter stage 46 to this fan cover. Fan cover 62, in turn, is force fit at its innermost portion 64 over an outer wall 66 of bearing retainer plate 52.

The flow of fan driven air 68 is generally from leftward to rightward in FIG. 1, passing through an aperture 70 in fan cover 50, fan 26, inter stage 46, fan 28, after stage 48 and bearing retainer plate 52, through openings 72, 72, to thereby pass into the electric motor 12 to cool it. It is discharged from the end of the motor through conventional slots (not shown). It is to be noted that the staged fan system 14 is not provided primarily for motor cooling but is operative to move a substantial flow of air such as necessitated by its use in a clean air system canister cleaner or the like. Its use is not limited, however, to this function since it would find general utilizity in the motor driven fan art. The fans and the inter and after stages 46 and 48 will now be described.

The inter stage 46 is shown more specifically in FIGS. 5–9. As can be seen, it is of molded configuration and includes a back plate 74 with a central hub 76 for shaft 70 through mounting, as previously described. Mounted on an interior side 78 of the inter stage 46 are a series of conventional concentric equally spaced curvilinear integral, spiralling blade portions 80, 80 (eight in number) which extend in an inward axial direction for a limited amount to give them depth. These blade portions terminate at an outer circumference 82 of inter stage 46. A circumferentially and axially extending strengthening rim 84 is also present at this circumference on the exterior side 86 of the back plate 74 of inter stage 44.

The spiralling blades 80, 80, at the outer ends, terminate angularly (in an axial direction) to accommodate integral axially angled, curvilinear tips 88, 88 that are curvilinear, in plan, relative to the interior side 78 of inter stage 46. Each merges smoothly with an angled end 90 of the spiralling blades 80 and each is a continuation of the spiral of its blade 80. The lending edge of these blade tips includes a bevel 89 for smooth transition for air flow from the fan 26. The curvilinear tips 88, 88 do not overlap, one with the other, in the horizontal direction so that the leading edge (bevel 89) of one is offset at an angle 95 from a trailing edge 91 of the next blade 80. This angle is set at at least 5° to permit a relatively easy molding of the inter stage 46. The trailing edge 91 of each of the blades 80 is also beveled to provide a smooth merging of a tip 88 with a terminating flat edge 93 of its respective spiralling blade 80. The tip of the blades 88 is also angled relative to the axial direction of the inter stage 46 by an angle 97, the tangent of this angle selected to be as close to the ratio of the average axial velocity over the average tangential velocity of the operating range of air flow through the system. This provides a higher efficiency for the air flow system than would otherwise be obtainable.

Each of the blades 80, 80 have a tab 92 spaced along their spiral which extends axially and is inserted through slots (unnumbered) in second fan cover 62 and the tabs then struck over to non-rotationally mount the inter stage 46 to the motor fan system 10. First fan cover 50 is then located over it, and inserted over the end of second fan cover 62 to place it also in a non-rotational condition.

After stage 48 is quite similar to inter stage 46 in that it has a series of spiralling blades 94, 94 (six in number) a back plate 96, a rim (not seen) and axially angled spiralling tips 98, 98 each integral with blade 94. However the tips 98, 98 are extended and not truncated (to prevent overlap in inter stage 46) so they slowly narrow and merge smoothly in a spiralling fashion with a circumference 100 of the after stage 48. This increases static pressure recovery after that occasioned by inter stage 46 without acting as much of a limiting choke. This also reduces noise greatly over that generated by the inter stage 46 which is important because of the location of it in the system. A beveled portion 102 between the terminations of the tips 98 aids in this noise reduction. The nontruncated extension of the tips 98, 98 reduces the number of blades with tips that may be molded into the after stage thereby increasing the width of the air channels between. Thus, in order to insure more directed streamlined flow of air, splitter blades 104, 104 (six in number) are interposed between the blades 94, 94. Each of the blades 104 is curvilinear and spirals in a uniform manner relative to the blades 94, 94 but it includes no angularly angled tip and extends in its spiral, to substantially the circumference 100 of the after stage 48. At its outward end it includes a spiralling angled portion 106 which somewhat mirrors in its axial projection the surface 102 to limit noise.

All of the blades 94, 104 are stepped downwardly at their inner ends to provide inward portions 108 on blades 94 and inward portions 110 on blades 104. This advantageously, provides clearance for the interfitting of bearing retainer plate 52 with after stage 48.

Each of the fans 26, 28 includes inner and outer flanges 112, 114, with flange 112 including a fan eye 116 for the passage of air inwardly to a series of blades 118. The blades 118, include fangs 120 for attachment to the flanges 112, 114. No further description will be given relating to the fans 26, 28 since they are entirely conventional.

The description of the invention being generally completed, it should be obvious that a fan system has been provided which includes at least one stator stage in which the blading is continuous for the guidance of air in both an axial and a radial direction and that blades and blade tips of curvilinear and spiralling character have been adapted for this purpose and that such an arrangement would streamline air passing through it, increasing efficiency while at the same time reducing noise. It should be obvious that modifications to this description might occur to one skilled in the art which would still fall within its spirit and purview.

I claim:

1. A stator for a fan system extending in an axial direction and producing a flow of air including;

(a) a spiralling, extending fixed blade section centered on a center of said stator, (b) a blade tip attached to and forming a continuation of said spiralling, extending blade section, (c) said blade tip angled relative to the axial direction of said fan system, (d) the tangent of said angle of said blade tip being expressed by the average air axial velocity of said flow of air divided by the average air tangential velocity of said flow of air.

2. A stator for a fan system extending in an axial direction and having a circumference including;

(a) a series of spiralling blades centered on the center of said stator, (b) a series of blade tips integrally attached to said blades and extending curvilinearly and angularly relative to the axial direction of said stator, (c) said tips at their ends, opposite their attachment to said spiralling blades, being extended beyond said circumference and beveled in an inward direction from their outer terminations so that they merge smoothly with said circumference of said stator, and (d) said circumference terminating the outward spiral of said blades.

3. The stator for a fan system as set out in claim 2 wherein;

(a) a second series of spiralling blades centered on the center of said stator is provided, (b) said second series of spiralling blades alternating with said first series of spiralling blades on said stator, (c) each of said second series of spiralling blades terminating outwardly at the inward extent of one of said bevels.

* * * * *